US008278016B2

(12) United States Patent
Shimoyama et al.

(10) Patent No.: US 8,278,016 B2
(45) Date of Patent: Oct. 2, 2012

(54) ELECTROPHOTOGRAPHIC PHOTOCONDUCTOR

(75) Inventors: Keisuke Shimoyama, Numazu (JP); Eiji Kurimoto, Numazu (JP); Takaaki Ikegami, Susono (JP); Kohsuke Yamamoto, Numazu (JP); Tadayoshi Uchida, Kohfu (JP); Takumi Shinohara, Kohfu (JP); Hajime Suzuki, Kohfu (JP)

(73) Assignee: Ricoh Company, Ltd., Tokyo (JP)

( * ) Notice: Subject to any disclaimer, the term of this patent is extended or adjusted under 35 U.S.C. 154(b) by 557 days.

(21) Appl. No.: 12/480,702

(22) Filed: Jun. 9, 2009

(65) Prior Publication Data

US 2009/0311616 A1 Dec. 17, 2009

(30) Foreign Application Priority Data

Jun. 11, 2008 (JP) ..... 2008-152910

(51) Int. Cl.
*G03G 5/06* (2006.01)

(52) U.S. Cl. ..... 430/73; 430/78; 430/96

(58) Field of Classification Search ..... 430/73, 430/78, 96
See application file for complete search history.

(56) References Cited

U.S. PATENT DOCUMENTS 4,606,988 A * 8/1986 Sasaki ..... 430/58.75
5,324,610 A * 6/1994 Tanaka et al. ..... 430/83
5,449,580 A * 9/1995 Nakamori et al. ..... 430/58.25
5,578,405 A 11/1996 Ikegami et al.
5,702,855 A 12/1997 Ikegami et al.
6,030,736 A 2/2000 Ikegami et al.
6,432,596 B2 8/2002 Ikuno et al.
6,573,016 B2 6/2003 Kami et al.
6,641,964 B2 11/2003 Ikuno et al.
6,653,033 B1 11/2003 Kami et al.
6,777,149 B2 8/2004 Ikegami et al.
6,790,572 B2 9/2004 Tamoto et al.
6,824,939 B2 11/2004 Kurimoto et al.
6,844,124 B2 1/2005 Ikuno et al.
6,853,823 B2 2/2005 Sugino et al.
6,853,834 B2 2/2005 Kurimoto et al.
6,858,362 B2 2/2005 Tamoto et al.
6,861,188 B2 3/2005 Ikegami et al.
6,936,388 B2 8/2005 Suzuki et al.
6,975,830 B2 12/2005 Murakami et al.
6,993,267 B2 1/2006 Yoshiyuki et al.
6,993,281 B2 1/2006 Yoshizawa et al.
7,018,755 B2 3/2006 Ikegami et al.
(Continued)

FOREIGN PATENT DOCUMENTS

DE 100 20 692 A1 11/2000
(Continued)

OTHER PUBLICATIONS

English language machine translation of JP 2003-066636 (Mar. 2003).*

(Continued)

*Primary Examiner* — Christopher Rodee
(74) *Attorney, Agent, or Firm* — Oblon, Spivak, McClelland, Maier & Neustadt, L.L.P.

(57) ABSTRACT

An electrophotographic photoconductor including an electroconductive support and a photoconductive layer provided thereon, wherein the photoconductive layer includes a charge generating material, an electron transporting material and a hole transporting material, the electron transporting material being a diphenoquinone compound represented by formula (1) described herein, the hole transporting material being a compound represented by formula (2) described herein.

13 Claims, 3 Drawing Sheets

U.S. PATENT DOCUMENTS

| | | | | |
|---|---|---|---|---|
| 7,031,650 | B2 | 4/2006 | Kurimoto et al. | |
| 7,060,404 | B2 | 6/2006 | Kami et al. | |
| 7,110,699 | B2 | 9/2006 | Yoshizawa et al. | |
| 7,112,392 | B2 | 9/2006 | Shimada et al. | |
| 7,127,196 | B2 | 10/2006 | Kami et al. | |
| 7,160,658 | B2 | 1/2007 | Suzuki et al. | |
| 7,177,583 | B2 | 2/2007 | Kurimoto et al. | |
| 7,184,684 | B2 | 2/2007 | Murakami et al. | |
| 7,212,777 | B2 | 5/2007 | Takada et al. | |
| 7,220,522 | B2 | 5/2007 | Ikegami et al. | |
| 7,267,916 | B2 | 9/2007 | Sugino et al. | |
| 7,274,898 | B2 | 9/2007 | Nousho et al. | |
| 7,282,529 | B2 | 10/2007 | Tamoto et al. | |
| 7,292,817 | B2 | 11/2007 | Murakami et al. | |
| 7,295,796 | B1 | 11/2007 | Murakami et al. | |
| 7,314,693 | B2 | 1/2008 | Ikegami et al. | |
| 7,341,810 | B2 | 3/2008 | Kurimoto et al. | |
| 7,381,511 | B2 | 6/2008 | Ikegami et al. | |
| 7,391,994 | B2 | 6/2008 | Takada et al. | |
| 7,486,914 | B2 | 2/2009 | Kabata et al. | |
| 7,531,278 | B2 | 5/2009 | Sugino et al. | |
| 7,964,327 | B2 * | 6/2011 | Gondoh et al. | 430/58.85 |
| 8,026,027 | B2 * | 9/2011 | Wu | 430/58.8 |
| 2004/0197688 | A1 | 10/2004 | Tamoto et al. | |
| 2005/0026058 | A1 | 2/2005 | Kami et al. | |
| 2006/0141378 | A1 | 6/2006 | Takada et al. | |
| 2006/0199092 | A1 | 9/2006 | Sugino et al. | |
| 2007/0059039 | A1 | 3/2007 | Shimoyama et al. | |
| 2007/0059618 | A1 | 3/2007 | Kurimoto et al. | |
| 2007/0059619 | A1 | 3/2007 | Shimoyama et al. | |
| 2007/0117033 | A1 | 5/2007 | Sugino et al. | |
| 2007/0231733 | A1 | 10/2007 | Takada et al. | |
| 2007/0248901 | A1 | 10/2007 | Shimoyama et al. | |
| 2007/0264047 | A1 | 11/2007 | Kurimoto et al. | |
| 2007/0287083 | A1 | 12/2007 | Gondoh et al. | |
| 2008/0063447 | A1 | 3/2008 | Kawahara et al. | |
| 2008/0113286 | A1 | 5/2008 | Shimoyama et al. | |
| 2008/0223515 | A1 | 9/2008 | Sudo et al. | |
| 2008/0280221 | A1 | 11/2008 | Shimoyama et al. | |
| 2008/0292981 | A1 | 11/2008 | Toda et al. | |
| 2008/0305426 | A1 | 12/2008 | Kurimoto et al. | |
| 2009/0000445 | A1 | 1/2009 | Yamamoto et al. | |
| 2009/0004585 | A1 | 1/2009 | Suzuki et al. | |
| 2009/0068577 | A1 | 3/2009 | Ohta et al. | |

FOREIGN PATENT DOCUMENTS

| | | | | |
|---|---|---|---|---|
| EP | 0 591 010 | A1 | | 4/1994 |
| EP | 1 241 529 | A2 | | 9/2002 |
| JP | 60-175052 | | | 9/1985 |
| JP | 05127407 | A | * | 5/1993 |
| JP | 05150487 | A | * | 6/1993 |
| JP | 06123985 | A | * | 5/1994 |
| JP | 06130686 | A | * | 5/1994 |
| JP | 09-062018 | | | 3/1997 |
| JP | 2003066636 | A | * | 3/2003 |
| JP | 2003098704 | A | * | 4/2003 |
| JP | 2005215207 | A | * | 8/2005 |
| JP | 2005292354 | A | * | 10/2005 |

OTHER PUBLICATIONS

English language machine translation of JP 2003-098704 (Apr. 2003).*

English language machine translation of JP 2005-292354 (Oct. 2005).*

* cited by examiner

ELECTROPHOTOGRAPHIC PHOTOCONDUCTOR

BACKGROUND OF THE INVENTION

1. Field of the Invention

The present invention relates to an electrophotographic photoconductor useful in various electrostatic copying processes and devices for image forming (e.g., a copier, laser printer, etc.).

2. Discussion of the Background

Conventionally, as a photoconductive layer of an electrophotographic photoconductor for copiers and laser printers, a layer of selenium, selenium-tellurium, selenium-arsenic or amorphous silicon was used.

From a viewpoint of the structure of photosensitive layer, organic photoreceptors are classified into two types, that is, single-layer photoreceptors and multilayer photoreceptors.

The single-layer photoreceptors have a photosensitive layer that includes a charge generating material and a hole transporting material so that the single layer has both functions of a charge generating function and a charge transporting function.

The multilayer photoreceptor is a function-separated type photoconductor and includes a charge generation layer (CGL) and a charge transport layer (CTL) which are laminated. Both of single-layer photoreceptors and multilayer photoreceptors are practically used, but a charge transporting material with high electric charge mobility is demanded to achieve excellent sensitivity.

From the viewpoint of chargeability, the organic photoreceptors are classified into two types, that is, negatively chargeable photoreceptors and positively chargeable photoreceptors. Most charge transporting materials having high electric charge mobility are positively chargeable, so for actual use, negatively chargeable organic photoreceptors are major.

Photoreceptors are generally charged by corona discharge. As a large quantity of ozone is emitted by discharge, ozone pollutes room environment and photoreceptors tend to be deteriorated physically or chemically.

Filters for catching ozone were applied as an improvement, but the size of the apparatus becomes bigger and more complicated. On the other hand, other methods for charging that doesn't emit ozone are tried, but the process for electronograph becomes complicated.

Under this situation, positively chargeable photoreceptors that emit less ozone are demanded in the recent market, but for producing positively chargeable photoreceptors, an electron transport material having high electric charge mobility is required. So development of an electron transport material having not only high electric charge mobility but also low toxicity level and good compatibility with a binder resin is proceeding. Particularly, diphenoquinone compounds disclosed by Japanese patent No. 3778595 have excellent properties, so positively chargeable photoreceptors having the diphenoquinone compound provided an achievement in electrophotograph properties.

However, any positively chargeable photoreceptors that satisfy sensitivity of the photoconductor and durability when the photoconductor is used repeatedly have not yet been provided. Positively chargeable photoreceptors having a single photoconductive layer has a function of transporting both of electron and positive hole, and a function of charge generation as well. So a combination of each material, particularly combination of a hole transporting material and an electron transporting material is important. But the indication for choosing a hole transporting material and an electron transporting material was not clear. Photoconductor that includes a styryl compound is disclosed by examined published Japanese patent application No. H05-42611 (hereinafter referred to as JOP), but combination with diphenoquinone compound isn't disclosed.

Because of these reasons, a need exists for an electrophotographic photoconductor that satisfy high sensitivity and high stability.

SUMMARY OF THE INVENTION

Accordingly, an object of the present invention is to provide an electrophotographic photoconductor that provide high sensitivity and high stability.

These and other objects of the present invention, either individually or in combinations thereof, as hereinafter will become more readily apparent can be attained by an electrophotographic photoconductor comprising an electroconductive support and a photoconductive layer provided thereon, wherein said photoconductive layer comprises a charge generating material, an electron transporting material and a hole transporting material, wherein said electron transporting material is a diphenoquinone compound represented by the following formula (1) and said hole transporting material is a compound represented by the following formula (2):

(1)

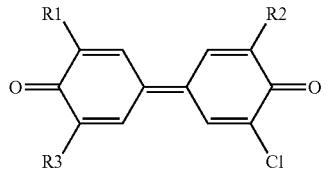

(2)

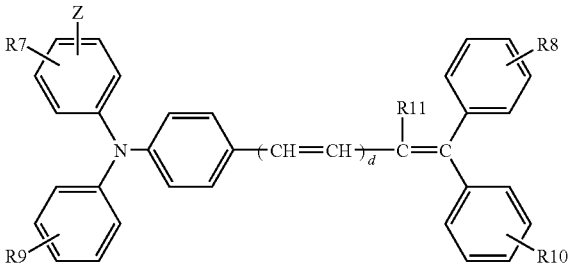

wherein R1-R3 independently represent an saturated hydrocarbyl group, R7-R11 independently represent a hydrogen atom, a substituted or unsubstituted alkyl group, a substituted or unsubstituted alkoxyl group, a substituted or unsubstituted aryl group, or a substituted or unsubstituted heterocyclic group, d is an integer of 0 or 1, Z represents a hydrogen atom, a substituted or unsubstituted alkyl group, a substituted or unsubstituted alkoxyl group, a substituted or unsubstituted aryl group, or a group represented by the following formula (Z), or R7 and Z define a ring fused to the aromatic ring of the formula (2), R12 and R13 independently represent a hydrogen atom, a substituted or unsubstituted alkyl group, a substituted or unsubstituted alkoxyl group, or a substituted or unsubstituted arl group, p is an integer of 0 or 1.

(z)

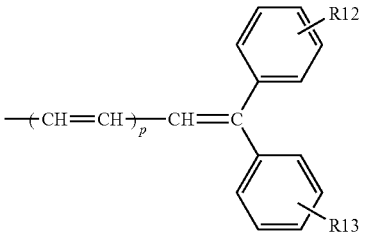

It is preferred that, in an electrophotographic photoconductor mentioned above, said diphenoquinone compound is a compound represented by the following formula (1a):

(1a)

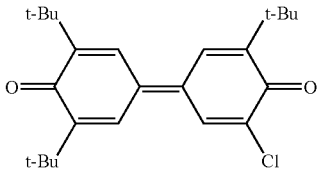

wherein t-Bu represents tert-butyl.

It is preferred that, in an electrophotographic photoconductor mentioned above, said hole transporting material is a compound represented by the following formula (3).

(3)

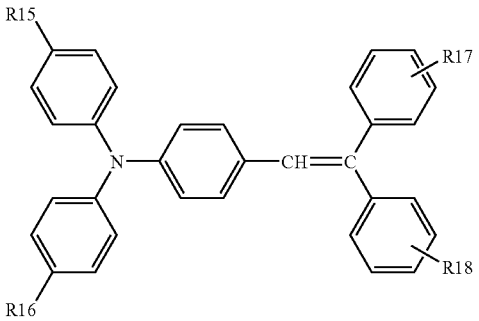

wherein R15-R18 independently represent a hydrogen atom, a substituted or unsubstituted alkyl group, a substituted or unsubstituted alkoxyl group, or a substituted or unsubstituted aryl group.

It is preferred that, in an electrophotographic photoconductor mentioned above, said hole transporting material is a compound represented by the following formula (4):

(4)

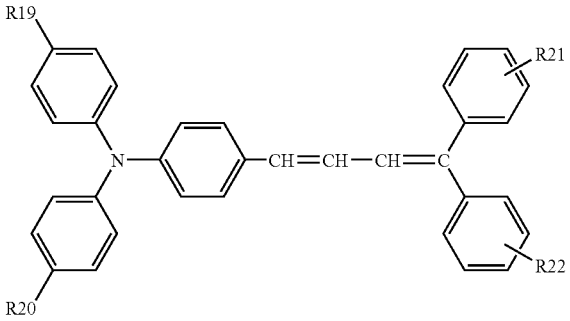

wherein R19-R22 independently represent a hydrogen atom, a substituted or unsubstituted alkyl group, a substituted or unsubstituted alkoxyl group, or a substituted or unsubstituted aryl group.

It is preferred that, in an electrophotographic photoconductor mentioned above, said hole transporting material is a compound represented by the following formula (5).

(5)

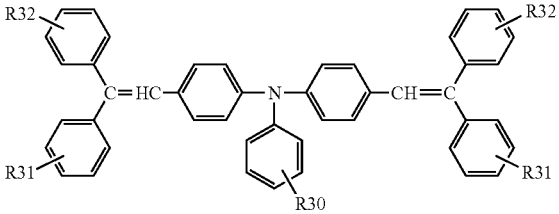

wherein R30-R32 independently represent a hydrogen atom, a substituted or unsubstituted alkyl group, a substituted or unsubstituted alkoxyl group, or a substituted or unsubstituted aryl group.

It is preferred that, in an electrophotographic photoconductor mentioned above, said charge generating material is a titanylphthalocyanine.

It is preferred that, in an electrophotographic photoconductor mentioned above, said titanylphthalocyanine has a main CuKα 1.542 Å diffraction peak at a Bragg (2θ) angle of 27.3±0.2°.

BRIEF DESCRIPTION OF THE DRAWINGS

These and other objects, features and advantages of the present invention will become apparent upon consideration of the following description of the preferred embodiments of the present invention taken in conjunction with the accompanying drawings, wherein.

DETAILED DESCRIPTION OF THE INVENTION

The present invention will be described below in detail with reference to several embodiments and accompanying drawings. As used herein, the term "a" and "an" and the like carry the meaning of "one or more."

A single-layer photoreceptor has a single photoconductive layer that has a function of transporting both of electron and positive hole, so both of a hole transporting material and an electron transporting material should have excellent properties.

Conventionally, electric charge mobility of electron transporting material wasn't sufficient, but electron transporting material represented by the formula (1) has a high electric charge mobility and it has an excellent compatibility with binder resins so it can be scattered or dissolved in a photosensitive layer with high density. That's why a photosensitive layer has high electric charge mobility.

When a combination of an electron transporting material represented by the formula (1) and a hole transporting material represented by the formula (2) is included in a photoconductive layer, an electrophotographic photoconductor having sufficient electric charge mobility and hole mobility is provided. In addition, the electrophotographic photoconductor has stable electrostatic properties such as sensitivity and chargeability by using repeatedly.

Figure 2:
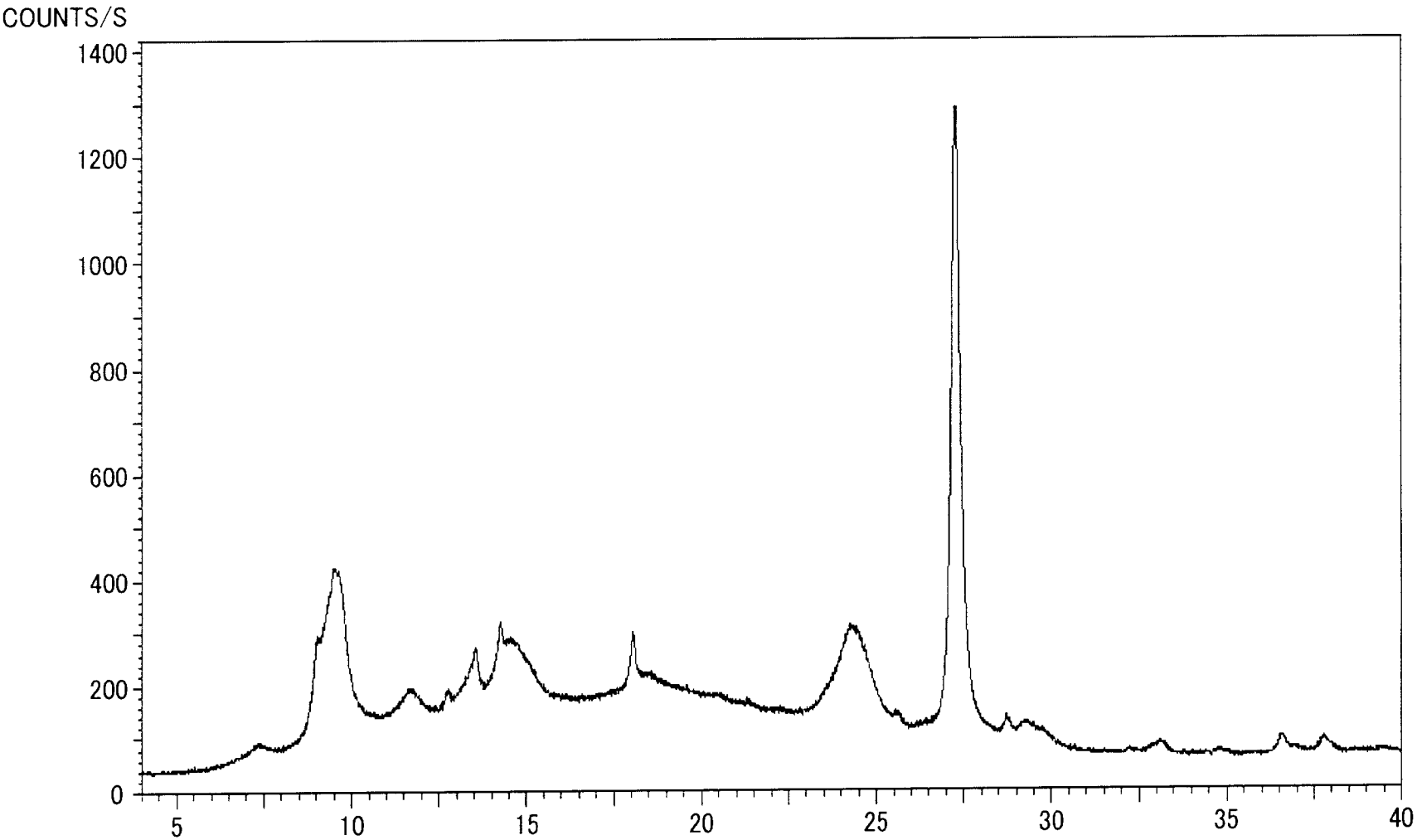
FIG. 2 is a X-ray diffraction spectra diagram of a titanylphthalocyanine used in Examples.
Figure 3:
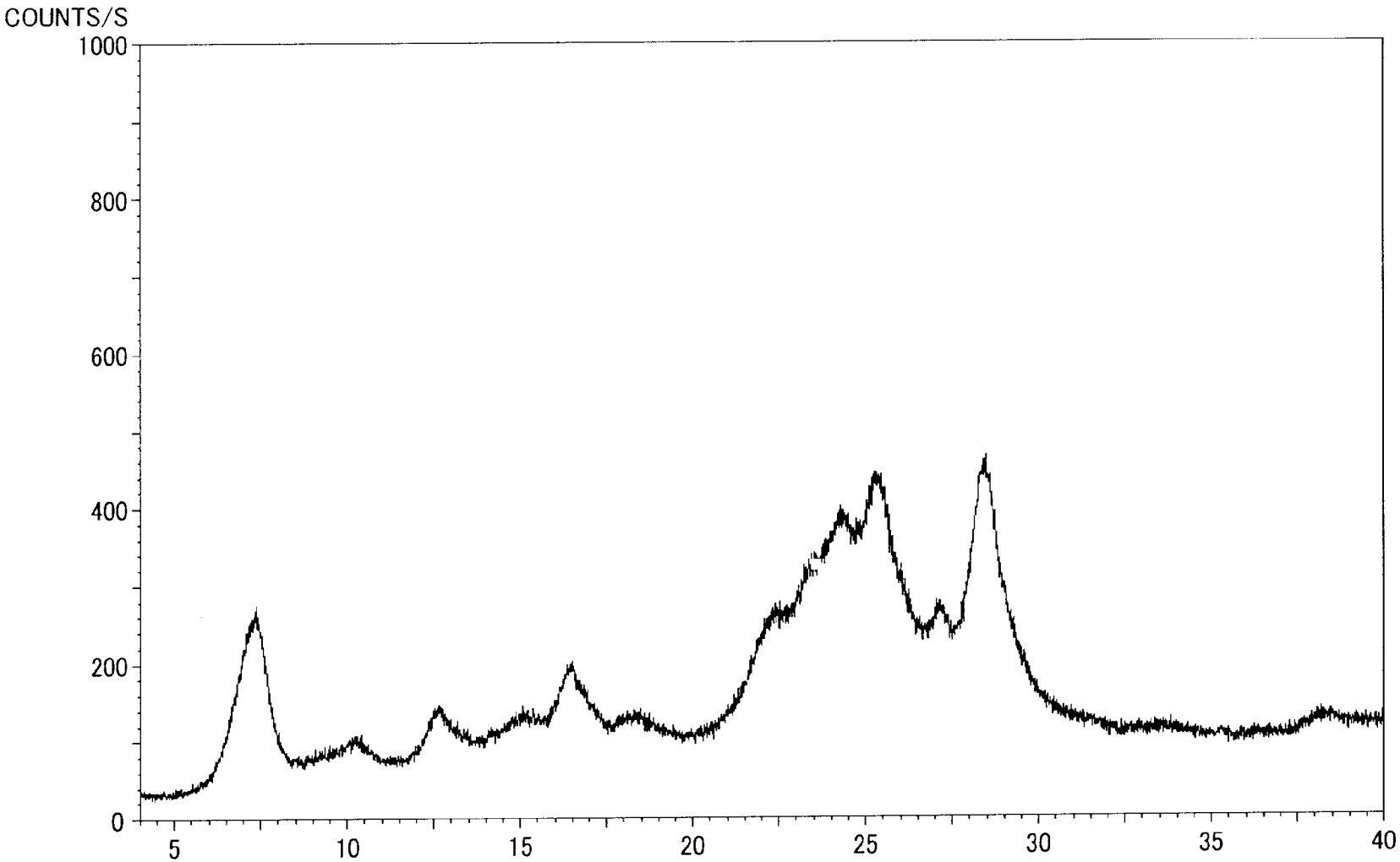
FIG. 3 is another X-ray diffraction spectra diagram of a titanylphthalocyanine used in Examples.

When a combination of diphenoquinone compound represented by the formula (1) and a hole transporting material represented by the formula (2) is used, particularly a combination with titanylphthalocyanine as a charge generating material is preferable. Particularly using a titanylphthalocyanine which has a main CuKα 1.542 Å diffraction peak at a Bragg (2θ) angle of 27.3±0.2° is preferable (FIG. 2). And using a titanylphthalocyanine which has CuKα 1.542 Å diffraction broad peaks at a Bragg (2θ) angle of 7.6±0.2° and 28.6±0.2° is also preferable (FIG. 3). The titanylphthalocyanine which has broad peaks at a Bragg (2θ) angle of 7.6±0.2° and 28.6±0.2° does not have any other particular sharp peaks. Peaks can be broad, split or shifted depending on crystalline state or measurement condition.

Using a combination of an electron transporting material and a hole transporting material of the present invention, the following properties can be provided.

(1) As a transfer of electrons and holes are smooth, sensitivity can be kept and deterioration caused by repeating of charging and exposure can be prevented.

(2) In addition, putting together with a titanylphthalocyanine represented by, e.g., FIG. 2 as a charge generating material, a photoreceptor having high sensitivity and stability for charging can be provided, because of high efficiency of charge generation and high efficiency of holes transporting.

Combination of a hole transporting material and an electron transporting material by the present invention is appropriate, movement of holes and electrons is efficiently, so high sensitivity and stability of charging by using repeatedly can be provided. As the result, the image forming apparatus comprising the photoreceptor satisfies stable image quality and high speed image forming.

Figure 1:
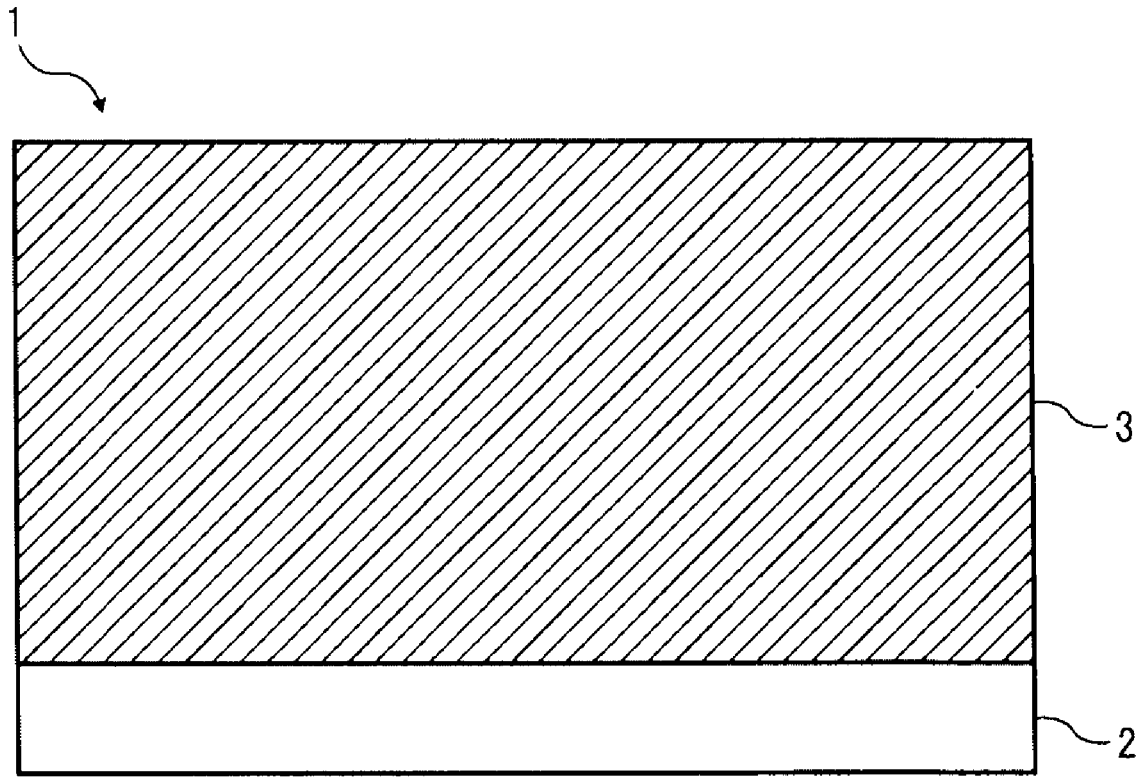
FIG. 1 is a cross-section view showing a configuration of the electrophotographic photoconductor of the present invention.

FIG. 1 is a cross-section view showing a configuration of the electrophotographic photoconductor of the present invention. There is a photoconductive layer (3) on a conductive substrate (2).

The electroconductive substrate 2 for use in the present invention may be formed of various electroconductive materials and may be of any material and shape. For example, it may be a metal article of a metal or an alloy of metals, including aluminum, brass, stainless steel, nickel, chromium, titanium, gold, silver, copper, tin, platinum, molybdenum and indium; it may be a plastic plate or film with an electroconductive material, such as the aforementioned metal or carbon, vapor-deposited or plated thereon to impart conductivity; or it may be an electroconductive glass plate coated with tin oxide, indium oxide or aluminum iodide.

Cylindrical aluminum tubes are commonly used, and may or may not be surface-treated by aluminum-anodizing. A resin layer may be deposited on the surface of the aluminum tube, or on the anodized aluminum layer in the case of the surface-treated tube.

A photoconductive layer of the present invention includes a charge generating material, a diphenoquinone compound represented by the formula (1) and a hole transporting material represented by the formula (2).

Firstly, charge generation materials will be explained in detail.

Any known charge generation materials can be used for the present invention. Specific preferred example of suitable charge generation material is titanylphthalocyanine, but is not limited, selenium, selenium-tellurium, selenium-arsenic, amorphous silicon, other phthalocyanine pigments, monoazo pigments, disazo pigments, trisazo pigments, polyazo pigments, indigoid pigments, threne pigments, toluidine pigments, pyrazoline pigments, perylene pigments, quinacridone pigments, pyrylium salt can be used.

These charge generation materials can be used alone or in combination.

It is preferable that the amount of a charge generating material in photoconductive layer is a range of 0.005 to 70 weight %, preferably a range of 0.5 to 5 weight %, based on total weight. When the amount of a charge generating material is in this range, sensitivity of photoconductor, chargeability of photoconductor and intensity of photoconductor is excellent.

Next, charge transporting materials will be explained in detail.

A diphenoquinone compound of the present invention is represented by the formula (1)

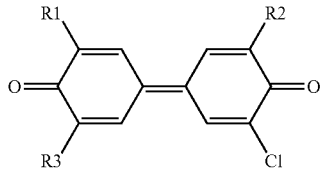

(1)

wherein R1-R3 independently represent any one of a saturated hydrocarbyl group.

As saturated hydrocarbyl groups, linear saturated hydrocarbyl group, such as methyl, ethyl, propyl, branched saturated hydrocarbyl group, such as, isopropyl, isobutyl, sec-butyl, tert-butyl, tert-pentyl, saturated cyclic hydrocarbyl group, such as, cyclopropyl, cyclobutyl, cyclopentyl, cyclohexyl, and also complex substituent that has a structure at least one of the linear saturated hydrocarbyl group, the branched saturated hydrocarbyl group or the saturated cyclic hydrocarbyl group can be used. Number of carbons included in the complex substituent is not limited.

The saturated hydrocarbyl group is preferably a saturated hydrocarbyl group having 1 to 25 carbon atoms, more preferably a saturated hydrocarbyl group having 1 to 12 carbon atoms, and particularly a saturated hydrocarbyl group having 1 to 6 carbon atoms.

By making contact a solution includes a compound represented by the formula (8) with HCL gas, an asymmetry diphenoquinone compound represented by the formula (1a) is provided.

(8)

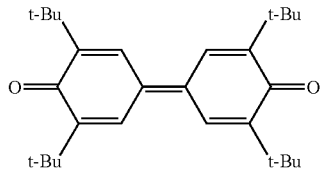

(1a)

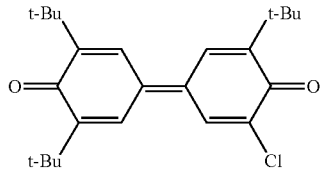

Wherein t-Bu means tert-butyl.

R1-R3 of the formula (1) are not limited to tert-butyl. When R1-R3 are methyl, a compound represented by the formula (1b) is provided. It is preferable that the amount of diphenoquinone compound in photoconductive layer is a range of 0.1 to 80 weight %, preferably a range of 0.5 to 50 weight %, based on total weight.

(1b)

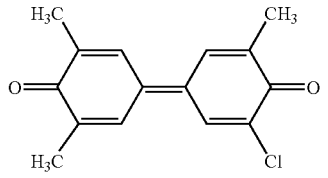

The diphenoquinone compounds represented by the formula (1) can be used alone or in combination.

A hole transporting material represented by the formula (2) has a following structure.

(2)

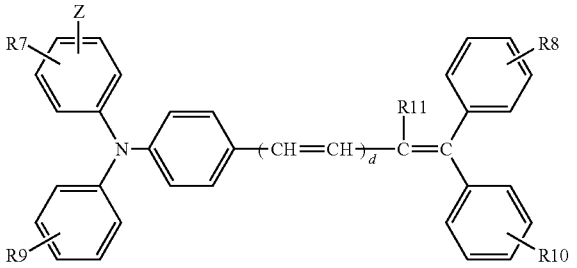

R7-R11 independently represent a hydrogen atom, a substituted or unsubstituted alkyl group, a substituted or unsubstituted alkoxyl group, a substituted or unsubstituted aryl group, or a substituted or unsubstituted heterocyclic group, d is an integer of 0 or 1, Z represents a hydrogen atom, a substituted or unsubstituted alkyl group, a substituted or unsubstituted alkoxyl group, a substituted or unsubstituted aryl group, or a group represented by the following formula (Z). R7 and Z can define a ring fused to the aromatic ring of the formula (2).

(z)

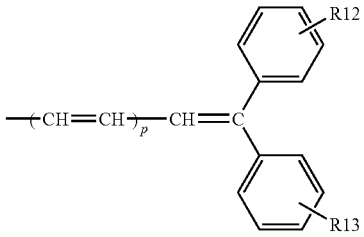

R12 and R13 independently represent a hydrogen atom, a substituted or unsubstituted alkyl group, a substituted or unsubstituted alkoxyl group, or a substituted or unsubstituted aryl group, p is an integer of 0 or 1. Hole transporting materials represented by the formula (3)-(5) are preferable.

(3)

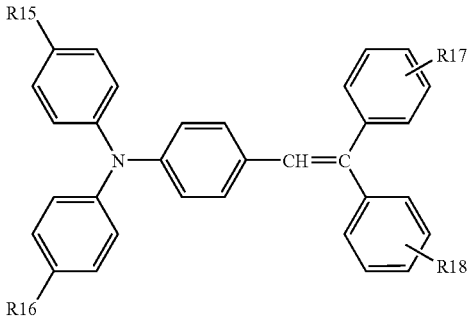

R15-R18 independently represent a hydrogen atom, a substituted or unsubstituted alkyl group, a substituted or unsubstituted alkoxyl group, or a substituted or unsubstituted aryl group.

(4)

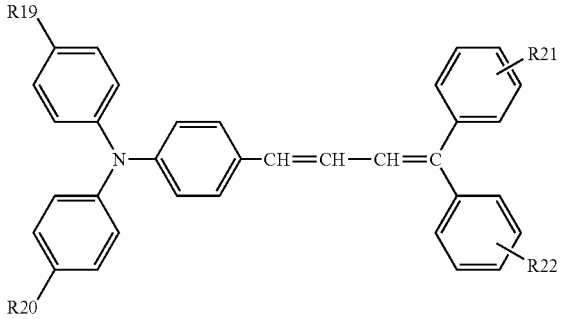

R19-R22 independently represent a hydrogen atom, a substituted or unsubstituted alkyl group, a substituted or unsubstituted alkoxyl group, or a substituted or unsubstituted aryl group.

(5)

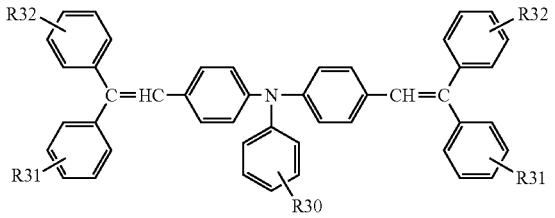

R30-R32 independently represent a hydrogen atom, a substituted or unsubstituted alkyl group, a substituted or unsubstituted alkoxyl group, or a substituted or unsubstituted aryl group.

In general formulae (2), (Z) and from (3) to (5) mentioned above, the alkyl group is preferably an alkyl group having 1 to 25 carbon atoms, more preferably an alkyl group having 1 to 12 carbon atoms, and particularly an alkyl group having 1 to 6 carbon atoms. Examples of such alkyl groups are methyl group, ethyl group, propyl group and butyl group. However, it is not limited to them. The aryl group above is preferably an aryl group having 6 to 30 carbon atoms, for example, phenyl group and naphthyl group. However, it is not limited to them. The alkoxyl group is preferably an alkoxyl group having 1 to 25 carbon atoms, more preferably an alkoxyl group having 1 to 12 carbon atoms, and particularly an alkoxyl group having 1 to 6 carbon atoms. Examples of such alkoxyl groups are methoxy, ethoxy and propoxy. The heterocyclic group above is preferably a heterocyclic group having 6 to 30 carbon atoms, for example, pyrazinyl group and quinolyl group. However, it is not limited to them. And they can be substituted by a halogen atom, a nitro group, a cyano group, an alkyl group having 1 to 25 carbon atoms, more preferably an alkyl group having 1 to 12 carbon atoms, such as methyl, ethyl, an alkoxyl group having 1 to 25 carbon atoms, such as, methoxy, ethoxy, an aryloxy group having 6 to 30 carbon atoms, such as phenoxy, an aryl group having 6 to 30 carbon atoms, such as phenyl, naphthyl, or an aralkyl group having 6 to 30 carbon atoms, such as benzyl and phenethyl.

Examples of a hole transporting material of the presented invention represented by the formula (2)-(5) are following.

(2a)

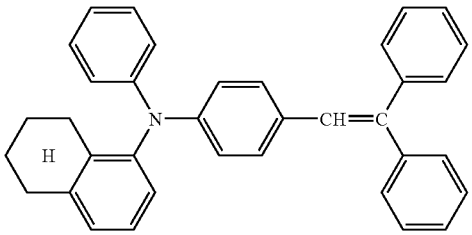

(2b)

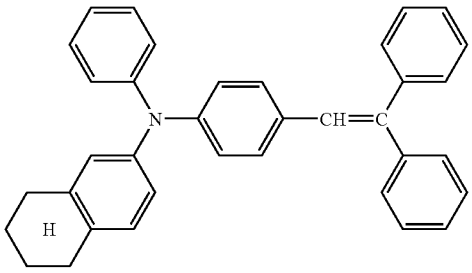

-continued (3a)

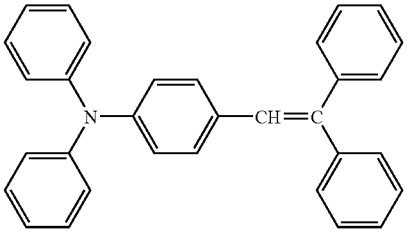

(3b)

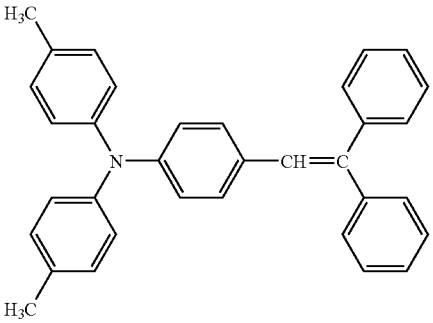

(3c)

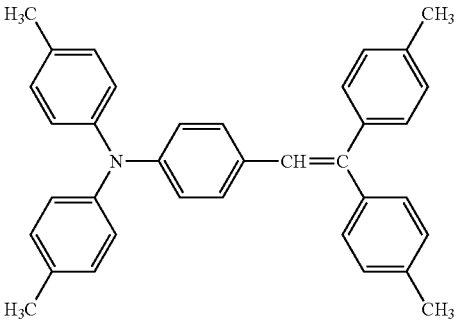

(4a)

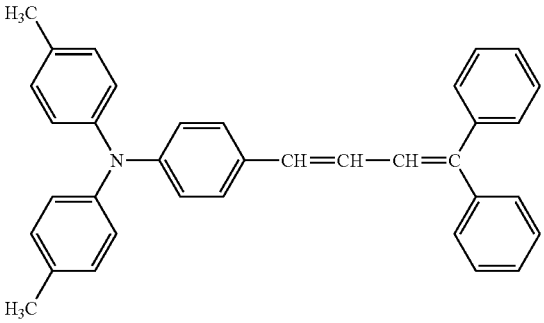

(4b)

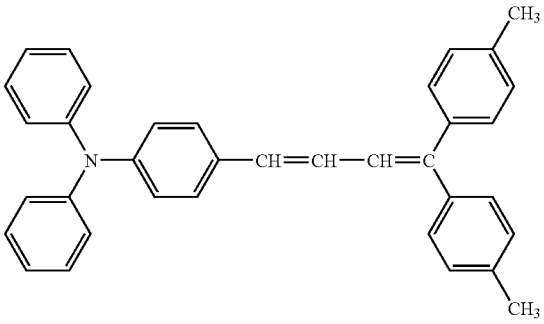

-continued (4c)

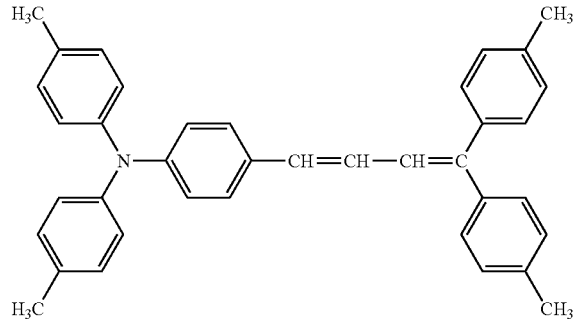

(5a)

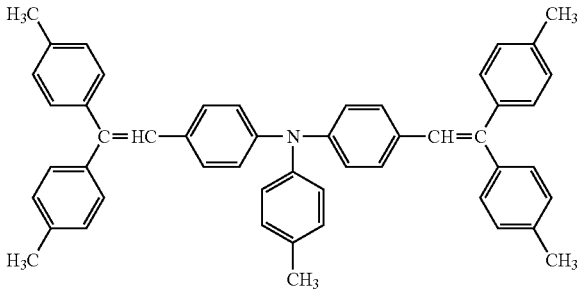

(5b)

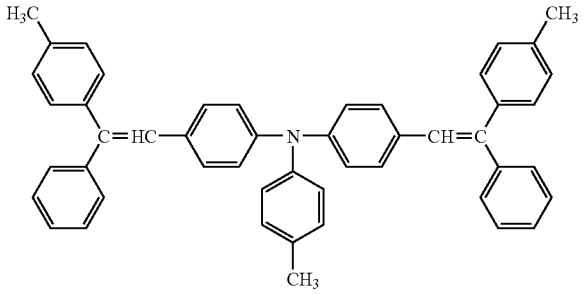

(5c)

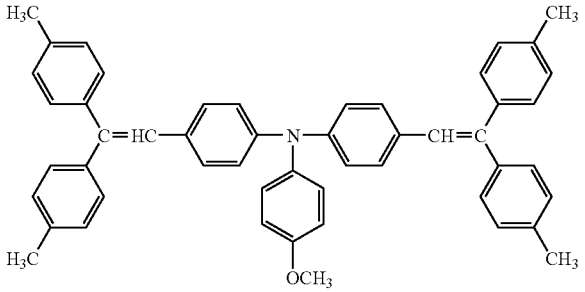

(5d)

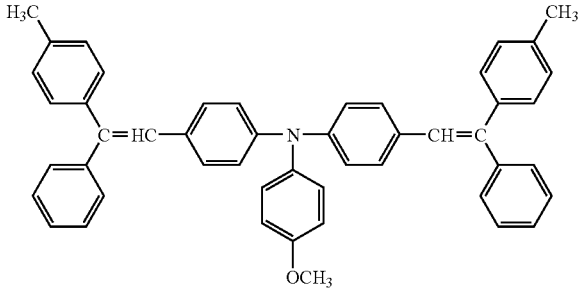

These compounds can be used alone or in combination in a photoconductive layer.

It is preferable that the amount of a hole transporting material in photoconductive layer is a range of 0.1 to 70 weight %, preferably a range of 0.5 to 50 weight %, based on total weight. When the amount of a hole transporting material is in this range, a property of photoconductor and intensity of photoconductive layer is excellent.

The photoconductor of the present invention includes both of diphenoquinone compound represented by the formula (1) and a hole transporting material represented by the formula (2), but also other charge transporting material can be added to the electrophotographic photoreceptor of the present invention. In such a case, the sensitivity is increased and the residual potential is decreased, with the result that characteristics of the electrophotographic photoreceptor of the present invention are improved.

An electroconductive high-molecular compound as a charge-transfer material may be added to the electrophotographic photoreceptor for the purpose of improving the characteristics of the photoreceptor. Examples of the electroconductive polymer include polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylene vinylene, polyisothianaphtene, polyaniline, polydiacetylene, polyheptadiene, polypyridinediyl, polyquinoline, polyphenylenesulfide, polyferrocenylene, polyperinaphthylene, and polyphthalocyanine.

Low-molecular compounds may also be used for this purpose, including polycyclic aromatic compounds such as anthracene, pyrene and phenanthrene, nitrogen-containing heterocyclic compounds such as indole, carbazole and imidazole, fluorenone, fluorene, oxadiazole, oxazole, pyrazoline, hydrazone, triphenylmethane, triphenylamine, enamine and stilbene compounds.

Also used are polymeric solid electrolytes obtained by doping polymers, such as polyethyleneoxide, polypropyleneoxide, polyacrylonitrile, poly methacrylic acid, with metal ions such as Li ions. Further, an organic electron-transfer complex may also be used that consists of an electron donor compound and an electron acceptor compound as represented by tetrathiafulvalene-tetracyanoquinodimethane. These compounds may be added independently or as a mixture of two or more compounds to obtain desired photosensitive characteristics.

Examples of the binder resins that can be used to form the photosensitive layer 3 include polycarbonate resin, styrene resin, acrylic resin, styrene-acrylic resin, ethylene-vinyl acetate resin, polypropylene resin, vinyl chloride resin, chlorinated polyether, vinyl chloride-vinyl acetate resin, polyester resin, furan resin, nitrile resin, alkyd resin, polyacetal resin, polymethylpentene resin, polyamide resin, polyurethane resin, epoxy resin, polyarylate resin, diarylate resin, polysulfone resin, polyethersulfone resin, polyarylsulfone resin, silicone resin, ketone resin, polyvinylbutyral resin, polyether resin, phenol resin, EVA (ethylene-vinyl acetate copolymer) resin, ACS (acrylonitrile-chlorinated polyethylene-styrene) resin, ABS (acrylonitrile-butadiene-styrene) resin and epoxy arylate. These resins may be used independently or as a mixture or a copolymer of two or more resins. Preferably, the resins with different molecular weights may be mixed together in order to enhance the hardness and wear-resistance.

Examples of the solvent for use in the coating solution include alcohols such as methanol, ethanol, 1-propanol, 2-propanol and butanol, saturated aliphatic hydrocarbons such as pentane, hexane, heptane, octane, cyclohexane and cycloheptane, aromatic hydrocarbons such as toluene and xylene, chloride-containing hydrocarbons such as dichloromethane, dichloroethane, chloroform, and chlorobenzene, ethers such as dimethylether, diethylether, tetrahydrofuran (THF) and methoxyethanol, ketones such as acetone, methyl ethyl ketone, methyl isobutyl ketone and cyclohexanone, esters such as ethyl formate, propyl formate, methyl acetate, ethyl acetate, propyl acetate, butyl acetate and methyl propionate, N,N-dimethylformamide and dimethylsulfoxide. These solvents may be used independently or as a mixture of two or more solvents.

In order to improve photosensitive characteristics, durability or mechanical properties of the photoreceptor of the present invention, antioxidants, UV-absorbing agents, radical scavengers, softeners, hardeners or cross-linking agents may be added to the coating solution for producing the photoreceptor of the present invention, provided that these agents do not affect the characteristics of the electrophotographic photoreceptor.

The finished appearance of the photoreceptor and the life of the coating solution are improved by further adding dispersion stabilizers, anti-settling agents, anti-flooding agents, leveling agents, anti-foaming agents, thickeners and flatting agents.

The resin layer is provided between electroconductive substrate and photosensitive layer for the purposes of enhancing adhesion, serving as a barrier to prevent electric current from flowing from the substrate and covering surface defects of the substrate. Various types of resin can be used in the resin layer, including polyethylene resin, acrylic resin, epoxy resin, polycarbonate resin, polyurethane resin, vinyl chloride resin, vinyl acetate resin, polyvinylbutyral resin, polyamide resin and nylon resin. The resin layer may be formed solely of a single resin, or it may be formed of a mixture of two or more resins. Further, metal oxides and carbon may be dispersed in the resin layer. The resin layer may include alumina.

In addition, a surface-protection layer may be provided on the photosensitive layer 3. The surface-protection layer may be organic film formed of polyvinylformal resin, polycarbonate resin, fluororesin, polyurethane resin or silicone resin, or it may be film formed of siloxane structure resulting from hydrolysis of silane coupling agents. In this manner, the durability of the photoreceptor is enhanced. The surface-protection layer may serve to improve functions other than the durability.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Manufacturing Example of Diphenoquinone Compound

Diphenoquinone compounds are obtained as follows.

30.0 g of 2,6-di-tert-butylphenol was dissolved in 300 ml of chloroform, 91.8 g of potassium permanganate was added, and stirred around 55-60° C. for 25 hours.

After inorganic compounds were removed by filtering, filtrate was concentrated and filtered. The residue was dissolve in 100 ml of chloroform and recrystallized by adding small amount of methanol, and 21.5 g of dark reddish-brown crystal of diphenoquinone compound was provided at a yield of 72%. The melting point of the crystal was 242-243° C.

3.0 g of the dark reddish-brown crystal of diphenoquinone compound was dissolved in a mixed liquid includes 300 ml of acetic acid and 120 ml of chloroform, introduced HCL gas under room temperature in a nitrogen atmosphere and reacted by stirring.

After introducing HCL gas for 7 hours, stirring was continued under room temperature overnight, deposition was removed by filtering. After filtrate was concentrated under vacuum, 300 ml of water was added and filtered, 3.8 g of yellow crystal was provided. Said 3.8 g of yellow crystal was dissolved in 25 ml of methanol, after that recrystallized by adding small amount of water, and 2.4 g of light yellow crystal of diphenol was provided at a yield of 84%. The melting point of the crystal was 150-151° C.

2.4 g of the diphenol was dissolved in 180 ml of chloroform, and 28.0 g of lead dioxide was added, after that stirred under room temperature for three hours, and residue was removed by filtering. After filtrate was concentrated, 20 ml of methanol was added and crystal was separated out. The crystal was filtered and washed with methanol, 1.9 g of purple-red crystal of diphenoquinone compound represented by the formula (1a) was provided at a yield of 81%. The melting point of the diphenoquinone compound was 155-156° C.

This reaction is shown by the following chemical equation:

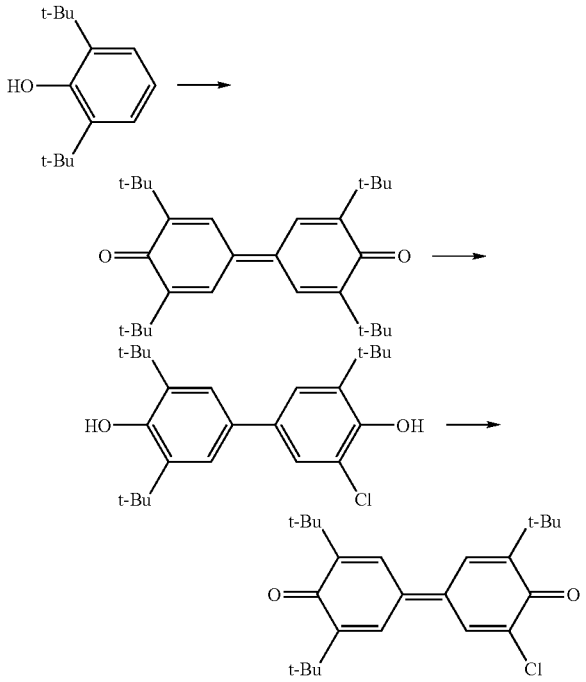

Diphenoquinone compound represented by the formula (1a) that was used in the following examples were produced by the method mentioned above.

[Manufacturing Example of Titanylphthalocyanine]

To a mixture of 64.4 g of phthalodinitrile and 150 ml of α-chloronaphthalene, 6.5 ml of titanium tetrachloride was added dropwise in nitrogen stream for 5 minutes. After the dropwise addition, the mixture was heated in a mantle heater to 200° C. for 2 hours in order to complete the reaction. The precipitate was filtered, and the filtered cake was rinsed with α-chloronaphthalene, and then rinsed with chloroform, and further rinsed with methanol. After that, the rinsed cake was treated by hydrolysis using a mixture of 60 ml of concentrated ammonia water and 60 ml of ion-exchanged water at boiling point for 10 hours. Then, the hydrolyzed mixture was subjected to suction-filtration at room temperature. The resulting cake was rinsed by pouring ion-exchanged water. The rinsing was continued until the filtrate ion-exchanged water became neutral.

Then, the cake was further rinsed with methanol, and was dried by hot air at 90° C. for 10 hours. The resulting product was 64.6 g of crystalline titanylphthalocyanine powder in blue-purple color.

The resulting powder was dissolved in about ten times its volume of concentrated sulfuric acid, and was then poured into water to generate precipitate, after that the mixture was filtered and wet cake was provided. Rinsing 30 g of the wet cake was continued until the filtrate ion-exchanged water became neutral, thereby 29 g of wet cake of titanylphthalocyanine was provided.

10 g of said wet cake was stirred together with 500 ml of tetrahydrofuran for 30 minutes and filtered. The temperature of the tetrahydrofuran was −5° C. The filtrate was dried and 9.5 g of titanylphthalocyanine was provided. The titanylphthalocyanine has a main CuKα 1.542 Å diffraction peak at a Bragg (2θ) angle of 27.3±0.2° (FIG. 2).

10 g of said wet cake was dried. The titanylphthalocyanine has CuKα 1.542 Å diffraction broad peaks at a Bragg (2θ) angle of 7.5° and 28.8° (FIG. 3).

Example 1

0.4 g of said Y-type titanylphthalocyanine produced by said manufacturing example which has a Bragg (2θ) angle of 27.3±0.2° (FIG. 2) was dispersed together with 10 ml of glass beads and 100 ml of tetrahydrofuran for 5 hours on a paint shaker. The glass beads were removed by filtering and 90 ml of dispersion was provided. And then, 9 parts by weight of the hole transporting material represented by the formula (3a), 6 parts by weight of the diphenoquinone compound represented by the formula (1a) and 15 parts by weight of Z type polycarbonate were added and dispersed, so that a dispersion solution for coating of photoconductive layer was obtained.

The dispersion solution was applied to an aluminum cylinder and was dried at 120° C. for 1 hour to form a 30 μm-thick photoconductive layer for a single-layer photoreceptor was provided.

Example 2

Example 1 was repeated in the same manner as described except that the hole transporting material represented by the formula (3a) was substituted for the hole transporting material represented by the formula (3b), thereby obtaining an electrophotographic photoconductor of Example 2.

Example 3

Example 1 was repeated in the same manner as described except that the hole transporting material represented by the formula (3a) was substituted for the hole transporting material represented by the formula (3c), thereby obtaining an electrophotographic photoconductor of Example 3.

Example 4

Example 1 was repeated in the same manner as described except that the hole transporting material represented by the formula (3a) was substituted for the hole transporting material represented by the formula (4a), thereby obtaining an electrophotographic photoconductor of Example 4.

Example 5

Example 1 was repeated in the same manner as described except that the hole transporting material represented by the formula (3a) was substituted for the hole transporting material represented by the formula (4b), thereby obtaining an electrophotographic photoconductor of Example 5.

Example 6

Example 1 was repeated in the same manner as described except that the hole transporting material represented by the formula (3a) was substituted for the hole transporting material represented by the formula (4c), thereby obtaining an electrophotographic photoconductor of Example 6.

Example 7

Example 1 was repeated in the same manner as described except that the hole transporting material represented by the formula (3a) was substituted for the hole transporting material represented by the formula (2a), thereby obtaining an electrophotographic photoconductor of Example 7.

Example 8

Example 1 was repeated in the same manner as described except that the hole transporting material represented by the formula (3a) was substituted for the hole transporting material represented by the formula (2b), thereby obtaining an electrophotographic photoconductor of Example 8.

Example 9

Example 1 was repeated in the same manner as described except that the hole transporting material represented by the formula (3a) was substituted for the hole transporting material represented by the formula (5a), thereby obtaining an electrophotographic photoconductor of Example 9.

Example 10

Example 1 was repeated in the same manner as described except that the hole transporting material represented by the formula (3a) was substituted for the hole transporting material represented by the formula (5b), thereby obtaining an electrophotographic photoconductor of Example 10.

Example 11

Example 1 was repeated in the same manner as described except that the hole transporting material represented by the formula (3a) was substituted for the hole transporting material represented by the formula (5c), thereby obtaining an electrophotographic photoconductor of Example 11.

Example 12

Example 1 was repeated in the same manner as described except that the hole transporting material represented by the formula (3a) was substituted for the hole transporting material represented by the formula (5d), thereby obtaining an electrophotographic photoconductor of Example 12.

Example 13

Example 1 was repeated in the same manner as described except that the diphenoquinone compound represented by the formula (1a) was substituted for the diphenoquinone compound represented by the formula (1b) and the hole transporting material represented by the formula (3a) was substituted for the hole transporting material represented by the formula (3c), thereby obtaining an electrophotographic photoconductor of Example 13.

Example 14

Example 1 was repeated in the same manner as described except that the diphenoquinone compound represented by the formula (1a) was substituted for the diphenoquinone compound represented by the formula (1b) and the hole transporting material represented by the formula (3a) was substituted for the hole transporting material represented by the formula (4a), thereby obtaining an electrophotographic photoconductor of Example 14.

Example 15

Example 1 was repeated in the same manner as described except that the diphenoquinone compound represented by the formula (1a) was substituted for the diphenoquinone compound represented by the formula (1b) and the hole transporting material represented by the formula (3a) was substituted for the hole transporting material represented by the formula (5a), thereby obtaining an electrophotographic photoconductor of Example 15.

Example 16

Example 1 was repeated in the same manner as described except that the hole transporting material represented by the formula (3a) was substituted for the hole transporting material represented by the formula (3b) and the charge generating material having a X-ray diffraction spectra represented by FIG. 2 was substituted for the charge generating material having a X-ray diffraction spectra represented by FIG. 3, thereby obtaining an electrophotographic photoconductor of Example 16.

Example 17

Example 1 was repeated in the same manner as described except that the hole transporting material represented by the formula (3a) was substituted for the hole transporting material represented by the formula (4b) and the charge generating material having a X-ray diffraction spectra represented by FIG. 2 was substituted for the charge generating material having a X-ray diffraction spectra represented by FIG. 3, thereby obtaining an electrophotographic photoconductor of Example 17.

Example 18

Example 1 was repeated in the same manner as described except that the hole transporting material represented by the formula (3a) was substituted for the hole transporting material represented by the formula (5a) and the charge generating material having a X-ray diffraction spectra represented by FIG. 2 was substituted for the charge generating material having a X-ray diffraction spectra represented by FIG. 3, thereby obtaining an electrophotographic photoconductor of Example 18.

Example 19

Example 1 was repeated in the same manner as described except that the hole transporting material represented by the formula (3a) was substituted for the hole transporting material represented by the formula (3b) and the charge generating material having a X-ray diffraction spectra represented by FIG. 2 was substituted for the disazo pigment represented by the formula (10), thereby obtaining an electrophotographic photoconductor of Example 19.

(10)

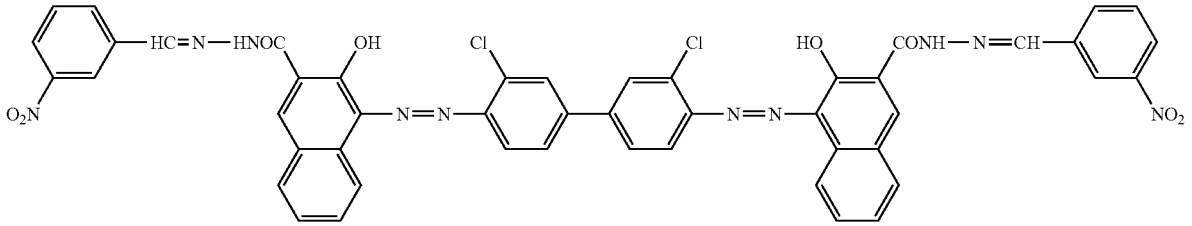

Example 20

Example 1 was repeated in the same manner as described except that the hole transporting material represented by the formula (3a) was substituted for the hole transporting material represented by the formula (5c) and the charge generating material having a X-ray diffraction spectra represented by FIG. 2 was substituted for the disazo pigment represented by the formula (10), thereby obtaining an electrophotographic photoconductor of Example 20.

Example 21

Example 1 was repeated in the same manner as described except that the hole transporting material represented by the formula (3a) was substituted for the hole transporting material represented by the formula (2a) and the charge generating material having a X-ray diffraction spectra represented by FIG. 2 was substituted for the disazo pigment represented by the formula (10), thereby obtaining an electrophotographic photoconductor of Example 21.

Comparative Example 1

Example 1 was repeated in the same manner as described except that the diphenoquinone compound represented by the formula (1a) was substituted for the diphenoquinone compound represented by the formula (11), thereby obtaining an electrophotographic photoconductor of Comparative Example 1.

(11)

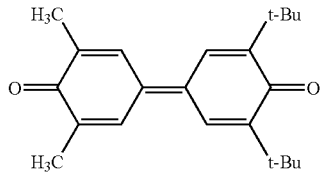

Comparative Example 2

Example 1 was repeated in the same manner as described except that the diphenoquinone compound represented by the formula (1a) was substituted for the diphenoquinone compound represented by the formula (11) and the hole transporting material represented by the formula (3a) was substituted for the hole transporting material represented by the formula (5a), thereby obtaining an electrophotographic photoconductor of Comparative Example 2.

Comparative Example 3

Example 1 was repeated in the same manner as described except that the hole transporting material represented by the formula (3a) was substituted for the hole transporting material represented by the formula (12), thereby obtaining an electrophotographic photoconductor of Comparative Example 3.

(12)

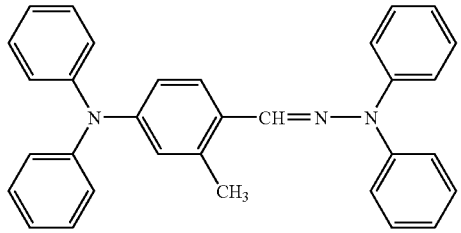

Comparative Example 4

Example 1 was repeated in the same manner as described except that the hole transporting material represented by the formula (3a) was substituted for the hole transporting material represented by the formula (13), thereby obtaining an electrophotographic photoconductor of Comparative Example 4.

(13)

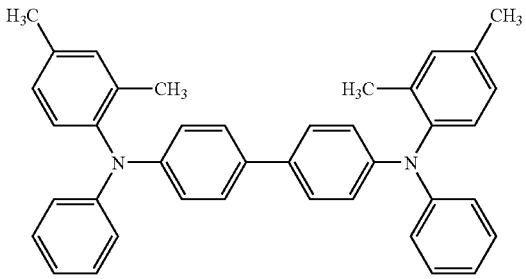

Comparative Example 5

Example 1 was repeated in the same manner as described except that the hole transporting material represented by the formula (3a) was substituted for the hole transporting material represented by the formula (14), thereby obtaining an electrophotographic photoconductor of Comparative Example 5.

(14)

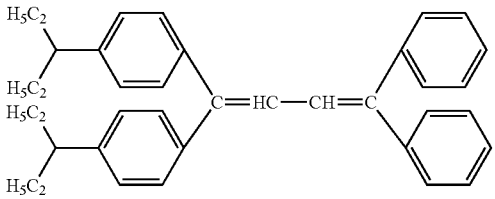

Comparative Example 6

Example 1 was repeated in the same manner as described except that the hole transporting material represented by the formula (3a) was substituted for the hole transporting material represented by the formula (15), thereby obtaining an electrophotographic photoconductor of Comparative Example 6.

(15)

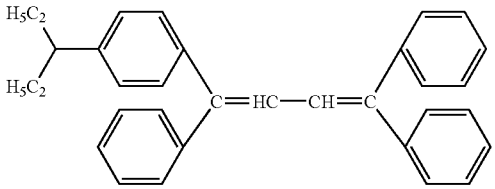

Comparative Example 7

Example 1 was repeated in the same manner as described except that the charge generating material having a X-ray diffraction spectra represented by FIG. 2 was substituted for the disazo pigment represented by the formula (10) and the hole transporting material represented by the formula (3a) was substituted for the hole transporting material represented by the formula (15), thereby obtaining an electrophotographic photoconductor of Comparative Example 7.

Comparative Example 8

Example 1 was repeated in the same manner as described except that the charge generating material having a X-ray diffraction spectra represented by FIG. 2 was substituted for the disazo pigment represented by the formula (10) and the hole transporting material represented by the formula (3a) was substituted for the hole transporting material represented by the formula (12), thereby obtaining an electrophotographic photoconductor of Comparative Example 8.

[Measurement Condition of Electrostatic for Single-Layered and Positively Charged Electrophotographic Photoconductors]

A corona discharger was adjusted to generate a corona discharge current of 20 μA. The electrophotographic photoconductors prepared in Application Examples 1 through 21 and Comparative Examples 1 through 8 were positively charged by the corona discharge in a dark environment and each photoreceptor was measured for the charged electric potential. The electric potential is an initial surface electric potential (V0). The surface electric potential indicates a chargeability of electrophotographic photoconductor. It is preferable that the surface electric potential is in a range of +600 to +800V.

After that, the corona discharger was adjusted so that the surface electric potential of electrophotographic photoconductors is 700V. The photoreceptors were then exposed with a light that has a wavelength of 780 nm, and exposure at which the absolute value of the surface potential of each electrophotographic photoreceptor decreased by half, from +700V down to +350V, was measured. The exposure is a half decay exposure E½(μJ/cm2). The half decay exposure reflects the sensitivity of the electrophotographic photoreceptor. When a half decay exposure is smaller, an electrophotographic photoreceptor is more sensitive. It is preferable that a half decay exposure is 0.45 μJ/cm2 or less, further preferable that a half decay exposure is 0.2 μJ/cm2 or less.

A surface electric potential of electrophotographic photoreceptors that was measured when a surface electric potential of electrophotographic photoreceptors was 700V and the light that has a wavelength of 780 nm was exposed (exposure energy is 2 μJ/cm2). This surface electric potential is residual potential (VL). The residual potential indicates remained charge on the surface of photoreceptors without decaying. When a residual potential is smaller is better. It is preferable that a residual potential is 100 V or less.

To evaluate the stability of photoreceptors in an image forming apparatus, charging of photoreceptors with 60 μA of corona discharge current and exposing of light having a wavelength of 780 nm with 2 μJ/cm2 of exposure energy were repeated 2000 times. After that surface electric potential of used photoreceptors was measured. This surface electric potential is V0'. Quantity of surface electric potential changing between V0' and V0. This quantity of change is ΔV0. ΔV0 is calculated by the following formula.

$$\Delta V0 = V0' - V0$$

It is preferable that ΔV0 is smaller. Because such photoreceptors have high durability.

These properties were measured under the temperature is 25° C. and humidity is 40%.

The results are shown in TABLE 1 and TABLE 2.

TABLE 1

| | Electron transporting material | Hole transporting material | Charge generating material |
|---|---|---|---|
| Example 1 | Formula (1a) | Formula (3a) | FIG. 2 |
| Example 2 | Formula (1a) | Formula (3b) | FIG. 2 |
| Example 3 | Formula (1a) | Formula (3c) | FIG. 2 |
| Example 4 | Formula (1a) | Formula (4a) | FIG. 2 |
| Example 5 | Formula (1a) | Formula (4b) | FIG. 2 |
| Example 6 | Formula (1a) | Formula (4c) | FIG. 2 |
| Example 7 | Formula (1a) | Formula (2a) | FIG. 2 |
| Example 8 | Formula (1a) | Formula (2b) | FIG. 2 |
| Example 9 | Formula (1a) | Formula (5a) | FIG. 2 |
| Example 10 | Formula (1a) | Formula (5b) | FIG. 2 |
| Example 11 | Formula (1a) | Formula (5c) | FIG. 2 |
| Example 12 | Formula (1a) | Formula (5d) | FIG. 2 |
| Example 13 | Formula (1b) | Formula (3c) | FIG. 2 |
| Example 14 | Formula (1b) | Formula (4a) | FIG. 2 |
| Example 15 | Formula (1b) | Formula (5a) | FIG. 2 |
| Example 16 | Formula (1a) | Formula (3b) | FIG. 3 |
| Example 17 | Formula (1a) | Formula (4b) | FIG. 3 |
| Example 18 | Formula (1a) | Formula (5a) | FIG. 3 |
| Example 19 | Formula (1a) | Formula (3b) | Formula (10) |
| Example 20 | Formula (1a) | Formula (5c) | Formula (10) |
| Example 21 | Formula (1a) | Formula (2a) | Formula (10) |
| Comparative Example 1 | Formula (11) | Formula (3a) | FIG. 2 |
| Comparative Example 2 | Formula (11) | Formula (5a) | FIG. 2 |
| Comparative Example 3 | Formula (1a) | Formula (12) | FIG. 2 |
| Comparative Example 4 | Formula (1a) | Formula (13) | FIG. 3 |
| Comparative Example 5 | Formula (1a) | Formula (14) | FIG. 3 |
| Comparative Example 6 | Formula (1a) | Formula (15) | FIG. 3 |
| Comparative Example 7 | Formula (1a) | Formula (15) | Formula (10) |
| Comparative Example 8 | Formula (1a) | Formula (12) | Formula (10) |

TABLE 2

| | V0 [V] | ΔV0 [V] | Em½ [μJ/cm2] | VL [V] |
|---|---|---|---|---|
| Example 1 | 720 | −70 | 0.13 | 60 |
| Example 2 | 730 | −76 | 0.12 | 55 |
| Example 3 | 755 | −75 | 0.11 | 59 |
| Example 4 | 780 | −96 | 0.11 | 50 |
| Example 5 | 778 | −90 | 0.11 | 51 |
| Example 6 | 770 | −89 | 0.12 | 53 |
| Example 7 | 795 | −55 | 0.14 | 80 |
| Example 8 | 785 | −60 | 0.14 | 77 |
| Example 9 | 785 | −100 | 0.1 | 45 |
| Example 10 | 790 | −96 | 0.11 | 49 |
| Example 11 | 783 | −107 | 0.11 | 50 |
| Example 12 | 788 | −80 | 0.12 | 46 |
| Example 13 | 755 | −77 | 0.14 | 76 |
| Example 14 | 778 | −95 | 0.13 | 62 |
| Example 15 | 787 | −112 | 0.13 | 52 |
| Example 16 | 790 | −63 | 0.2 | 89 |
| Example 17 | 786 | −86 | 0.19 | 76 |
| Example 18 | 778 | −91 | 0.16 | 70 |
| Example 19 | 790 | −30 | 0.23 | 96 |
| Example 20 | 795 | −87 | 0.2 | 86 |
| Example 21 | 795 | −25 | 0.19 | 92 |
| Comparative Example 1 | 588 | 230 | 0.65 | 223 |
| Comparative Example 2 | 567 | 180 | 0.55 | 245 |
| Comparative Example 3 | 624 | −180 | 0.29 | 110 |

TABLE 2-continued

| | V0 [V] | ΔV0 [V] | Em½ [μJ/cm2] | VL [V] |
|---|---|---|---|---|
| Comparative Example 4 | 590 | −175 | 0.4 | 105 |
| Comparative Example 5 | 574 | −196 | 0.62 | 251 |
| Comparative Example 6 | 632 | 279 | 0.75 | 332 |
| Comparative Example 7 | 821 | 180 | 0.82 | 400 |
| Comparative Example 8 | 823 | 225 | 0.76 | 376 |

V0 means an initial surface electric potential.

ΔV0 means a quantity of surface electric potential changing between V0' and V0.

Em½ means a half decay exposure.

VL means a residual potential.

Photoconductors of Example 1 through Example 21 have small E½ so they are sensitive. And also they have small ΔV0 and VL.

On the other hand, Photoconductors of Comparative Example 1 and Comparative Example 2 don't have enough charge transporting so sensitivity isn't enough. Because electron transporting material used in the Comparative Examples don't have symmetrical structure. And ΔV0 is high because of trapping of charge. Photoconductors of Comparative Example 3 through Comparative Example 8 don't have enough charge transporting so sensitivity isn't enough. VL and ΔV0 are not enough low.

This document claims priority and contains subject matter related to Japanese Patent Application No. 2008-152910 filed on Jun. 11, 2008, the entire contents of each of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. The electrophotographic photoconductor comprising:

an electroconductive support and a photoconductive layer thereon, wherein said photoconductive layer comprises a charge generating material, an electron transporting material and a hole transporting material, wherein said electron transporting material is a diphenoquinone compound represented by the following formula (1) and said hole transporting material is a compound represented by the following formula (2):

Formula (1)

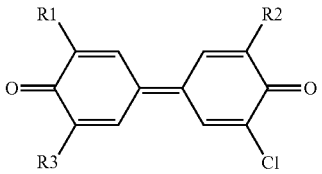

-continued

Formula (2)

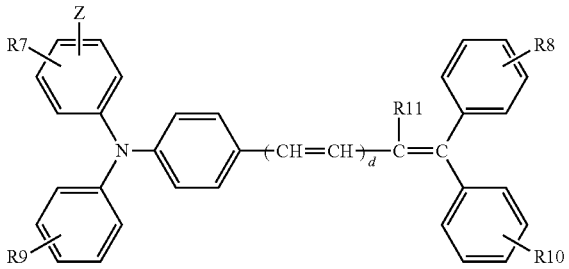

wherein R1-R3 independently represent an saturated hydrocarbyl group, R7-R11 independently represent a hydrogen atom, a substituted or unsubstituted alkyl group, a substituted or unsubstituted alkoxyl group, a substituted or unsubstituted aryl group, or a substituted or unsubstituted heterocyclic group, d is an integer of 0 or 1, Z represents a hydrogen atom, a substituted or unsubstituted alkyl group, a substituted or unsubstituted alkoxyl group, a substituted or unsubstituted aryl group, or a group represented by the following formula (A), or R7 and Z define a ring fused to the aromatic ring of the formula (2), R12 and R13 independently represent a hydrogen atom, a substituted or unsubstituted alkyl group, a substituted or unsubstituted alkoxyl group, a substituted or unsubstituted aryl group, p is an integer of 0 or 1

Formula (A)

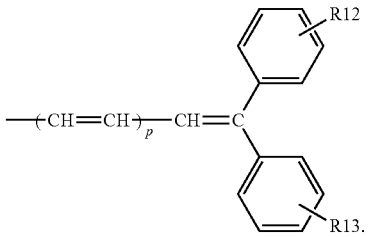

2. The electrophotographic photoconductor according to claim 1, wherein said diphenoquinone compound is a compound represented by the following formula (1 a):

Formula (1a)

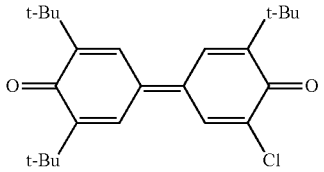

wherein t-Bu represents tert-butyl.

3. The electrophotographic photoconductor according to claim 1, wherein said hole transporting material is a compound represented by the following formula (3):

Formula (3)

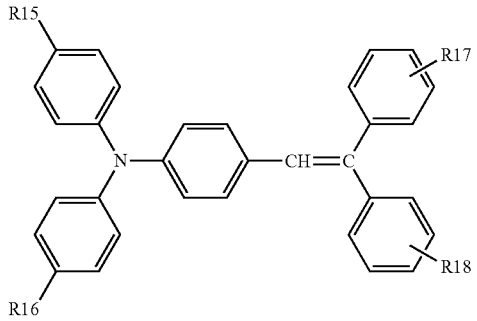

wherein R15-R18 independently represent a hydrogen atom, a substituted or unsubstituted alkyl group, a substituted or unsubstituted alkoxyl group, or a substituted or unsubstituted aryl group.

4. The electrophotographic photoconductor according to claim 1, wherein said hole transporting material is a compound represented by the following formula (4):

Formula (4)

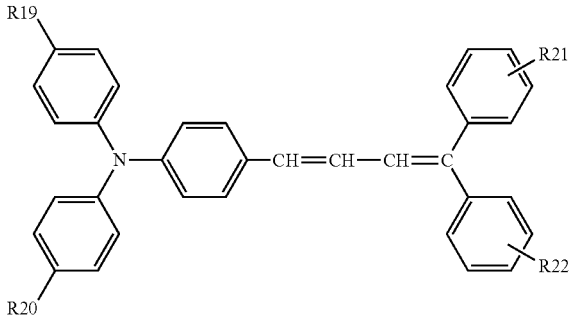

wherein R19-R22 independently represent a hydrogen atom, a substituted or unsubstituted alkyl group, a substituted or unsubstituted alkoxyl group, or a substituted or unsubstituted aryl group.

5. The electrophotographic photoconductor according to claim 1, wherein said hole transporting material is a compound represented by the following formula (5):

Formula (5)

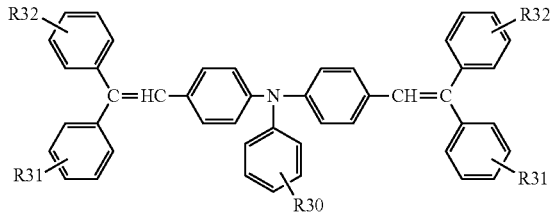

wherein R30-R32 independently represent a hydrogen atom, a substituted or unsubstituted alkyl group, a substituted or unsubstituted alkoxyl group, or a substituted or unsubstituted aryl group.

6. The electrophotographic photoconductor according to claim 1, wherein said charge generating material is a titanylphthalocyanine.

7. The electrophotographic photoconductor according to claim 6, wherein said titanylphthalocyanine has a main CuKα 1.542 Å diffraction peak at a Bragg (2θ) angle of 27.3±0.2°.

8. The electrophotographic photoconductor according to claim 1, wherein said photoconductor comprises the charge generating material in an amount of from 0.005 to 70 weight %, based on the total weight of the photoconductor.

9. The electrophotographic photoconductor according to claim 1, wherein said photoconductor comprises the charge generating material in an amount of from 0.5 to 5 weight %, based on the total weight of the photoconductor.

10. The electrophotographic photoconductor according to claim 1, wherein the hole transporting material is at least one compound selected from the group consisting of (2a)

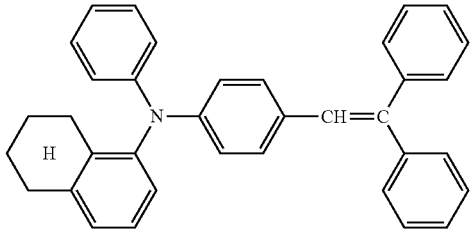

(2b)

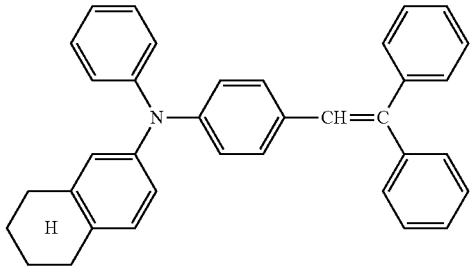

(3a)

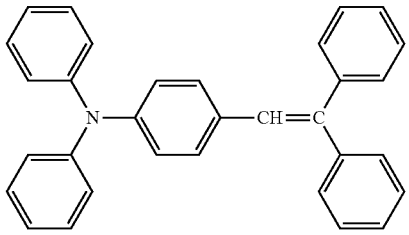

(3b)

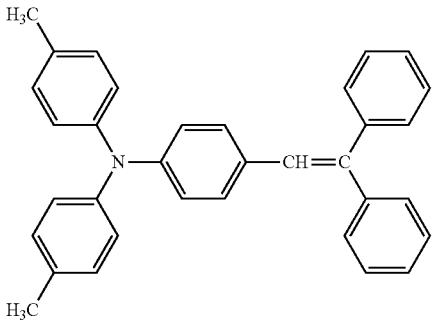

-continued
(3c)
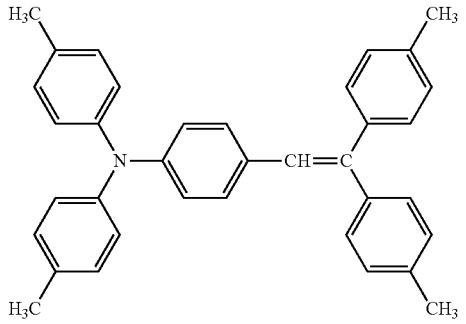
(4a)
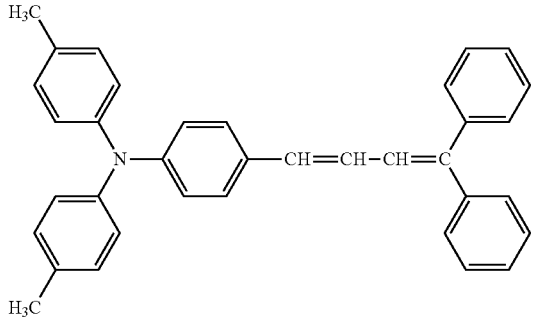
(4b)
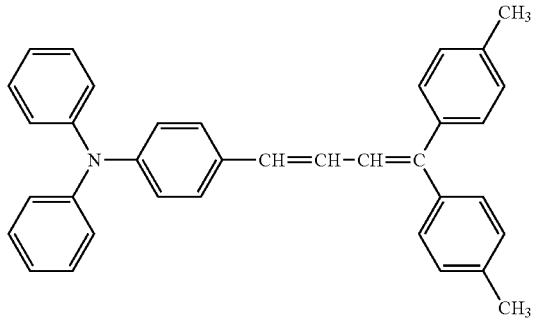
(4c)
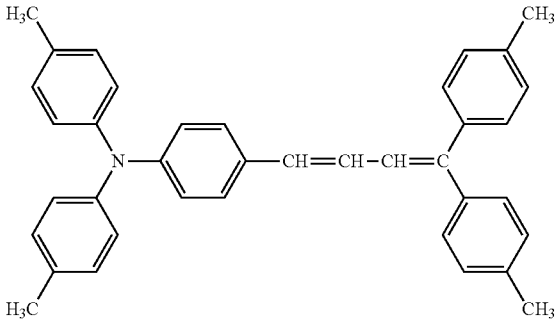
-continued
(5a)
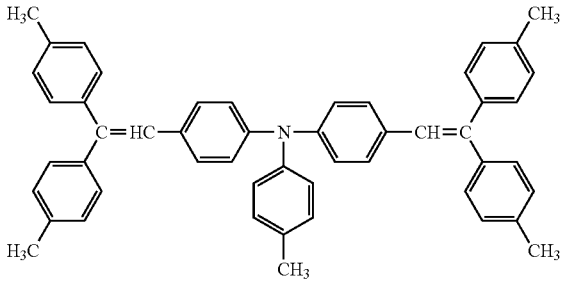
(5b)
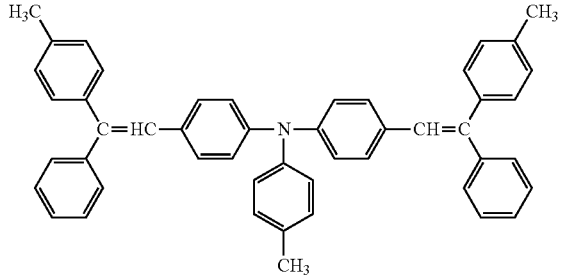
(5c)
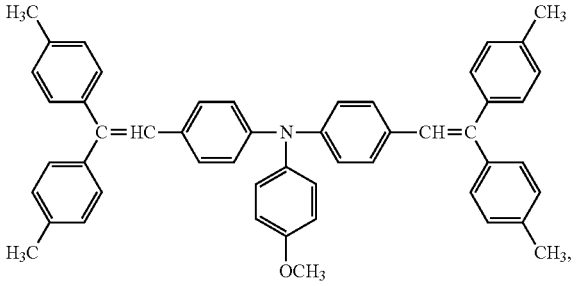
and
(5d)
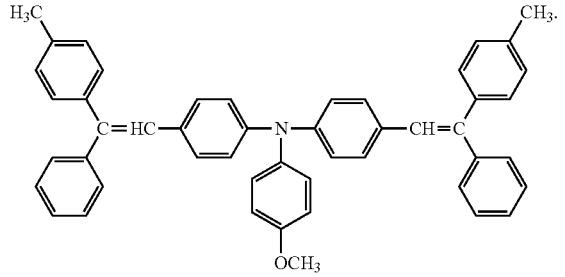
11. The electrophotographic photoconductor according to claim 1, wherein said photoconductor comprises the hole transporting material in an amount of from 0.1 to 70 weight %, based on the total weight of the photoconductor.

12. The electrophotographic photoconductor according to claim 1, wherein said photoconductor comprises the hole transporting material in an amount of from 0.5 to 50 weight %, based on the total weight of the photoconductor.

13. The electrophotographic photoconductor according to claim 1, wherein said photoconductor further comprises at least one electroconductive polymer selected from the group consisting of polyvinylcarbazole, halogenated polyvinylcarbazole, polyvinylpyrene, polyvinylindoloquinoxaline, polyvinylbenzothiophene, polyvinylanthracene, polyvinylacridine, polyvinylpyrazoline, polyacetylene, polythiophene, polypyrrole, polyphenylene, polyphenylene vinylene, polyisothianaphtene, polyaniline, polydiacetylene, polyheptadiene, polypyridinediyl, polyquinoline, polyphenylenesulfide, polyferrocenylene, polyperinaphthylene, and polyphthalocyanine.

* * * * *